US005496246A

United States Patent [19]

Pierre

[11] Patent Number: 5,496,246

[45] Date of Patent: Mar. 5, 1996

[54] RESILIENT TENSION EXERCISE APPARATUS

[76] Inventor: Yves J. Pierre, 120 Ellery Ave., Newark, N.J. 07106

[21] Appl. No.: 354,469

[22] Filed: Dec. 12, 1994

[51] Int. Cl.[6] ..... A63B 21/04

[52] U.S. Cl. ..... 482/130; 482/138; 482/139

[58] Field of Search ..... 482/121, 122, 482/123, 129, 130, 138, 72, 142, 132, 139, 95, 96

[56] References Cited

U.S. PATENT DOCUMENTS

| | | | |
|---|---|---|---|
| 4,468,025 | 8/1984 | Sferle | 482/96 |
| 4,700,946 | 10/1987 | Brevnig | 482/96 |
| 4,786,051 | 11/1988 | Mullican | 482/138 |
| 4,838,547 | 6/1989 | Sterling | 482/130 |
| 5,176,601 | 1/1993 | Reynolds | 482/130 |

*Primary Examiner*—Lynne A. Reichard
*Attorney, Agent, or Firm*—Hugh E. Smith

[57] ABSTRACT

An apparatus for exercising the limbs of an individual. The inventive device includes a frame assembly having a seat assembly adjustably positioned relative thereto. A plurality of resilient exercise assemblies are coupled to the frame assembly and can be tensioned by a user to exercise the arms and legs thereof. The exercise assemblies each include a pair of elongated springs or elastomeric elements coupled to the frame and terminating in a pair of grips engageable by either the hands or feet of the user.

16 Claims, 3 Drawing Sheets

RESILIENT TENSION EXERCISE APPARATUS

BACKGROUND OF THE INVENTION

1. Field of the Invention

The present invention relates to exercise devices and more particularly pertains to a resilient tension exercise apparatus for exercising the limbs of an individual.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 5,183,452; U.S. Pat. No. 5184,991; U.S. Pat. No. 5,232,426; U.S. Pat. No. 5,250,013; and U.S. Pat. No. 5,269,736.

While these devices fulfill their respective, particular objectives and requirements, the aforementioned patents do not disclose a resilient tension exercise apparatus for exercising the limbs of an individual which includes a frame assembly having a seat assembly adjustably positioned relative thereto, and a plurality of resilient exercise assemblies coupled to the frame assembly and operable to be tensioned by a user to exercise the arms and legs thereof, wherein the exercise assemblies each include a pair of elongated springs or elastomeric elements coupled to the frame and terminating in a pair of grips.

In these respects, the resilient tension exercise apparatus according to the present invention substantially departs from the conventional concepts and designs of the prior art, and in so doing provides an apparatus primarily developed for the purpose of exercising the limbs of an individual.

SUMMARY OF THE INVENTION

In view of the foregoing disadvantages inherent in the known types of exercise devices now present in the prior art, the present invention provides a new resilient tension exercise apparatus construction wherein the same can be utilized for exercising the limbs of an individual. As such, the general purpose of the present invention, which will be described subsequently in greater detail, is to provide a new resilient tension exercise apparatus and method which has many of the advantages of the exercise devices mentioned heretofore and many novel features that result in a resilient tension exercise apparatus which is not anticipated, rendered obvious, suggested, or even implied by any of the prior art exercise devices, either alone or in any combination thereof.

To attain this, the present invention generally comprises an apparatus for exercising the limbs of an individual. The inventive device includes a frame assembly having a seat assembly adjustably positioned relative thereto. A plurality of resilient exercise assemblies are coupled to the frame assembly and can be tensioned by a user to exercise the arms and legs thereof. The exercise assemblies each include a pair of elongated springs or elastomeric elements coupled to the frame and terminating in a pair of grips engageable by either the hands or feet of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new resilient tension exercise apparatus and method which has many of the advantages of the exercise devices mentioned heretofore and many novel features that result in a resilient tension exercise apparatus which is not anticipated, rendered obvious, suggested, or even implied by any of the prior art exercise devices, either alone or in any combination thereof.

It is another object of the present invention to provide a new resilient tension exercise apparatus which may be easily and efficiently manufactured and marketed.

It is a further object of the present invention to provide a new resilient tension exercise apparatus which is of a durable and reliable construction.

An even further object of the present invention is to provide a new resilient tension exercise apparatus which is susceptible of a low cost of manufacture with regard to both materials and labor, and which accordingly is then susceptible of low prices of sale to the consuming public, thereby making such resilient tension exercise apparatuses economically available to the buying public.

Still yet another object of the present invention is to provide a new resilient tension exercise apparatus which provides in the apparatuses and methods of the prior art some of the advantages thereof, while simultaneously overcoming some of the disadvantages normally associated therewith.

Still another object of the present invention is to provide a new resilient tension exercise apparatus for exercising the limbs of an individual.

Yet another object of the present invention is to provide a new resilient tension exercise apparatus which includes a frame assembly having a seat assembly adjustably positioned relative thereto, and a plurality of resilient exercise assemblies coupled to the frame assembly and operable to be tensioned by a user to exercise the arms and legs thereof, wherein the exercise assemblies each include a pair of elongated springs or elastomeric elements coupled to the frame and terminating in a pair of grips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
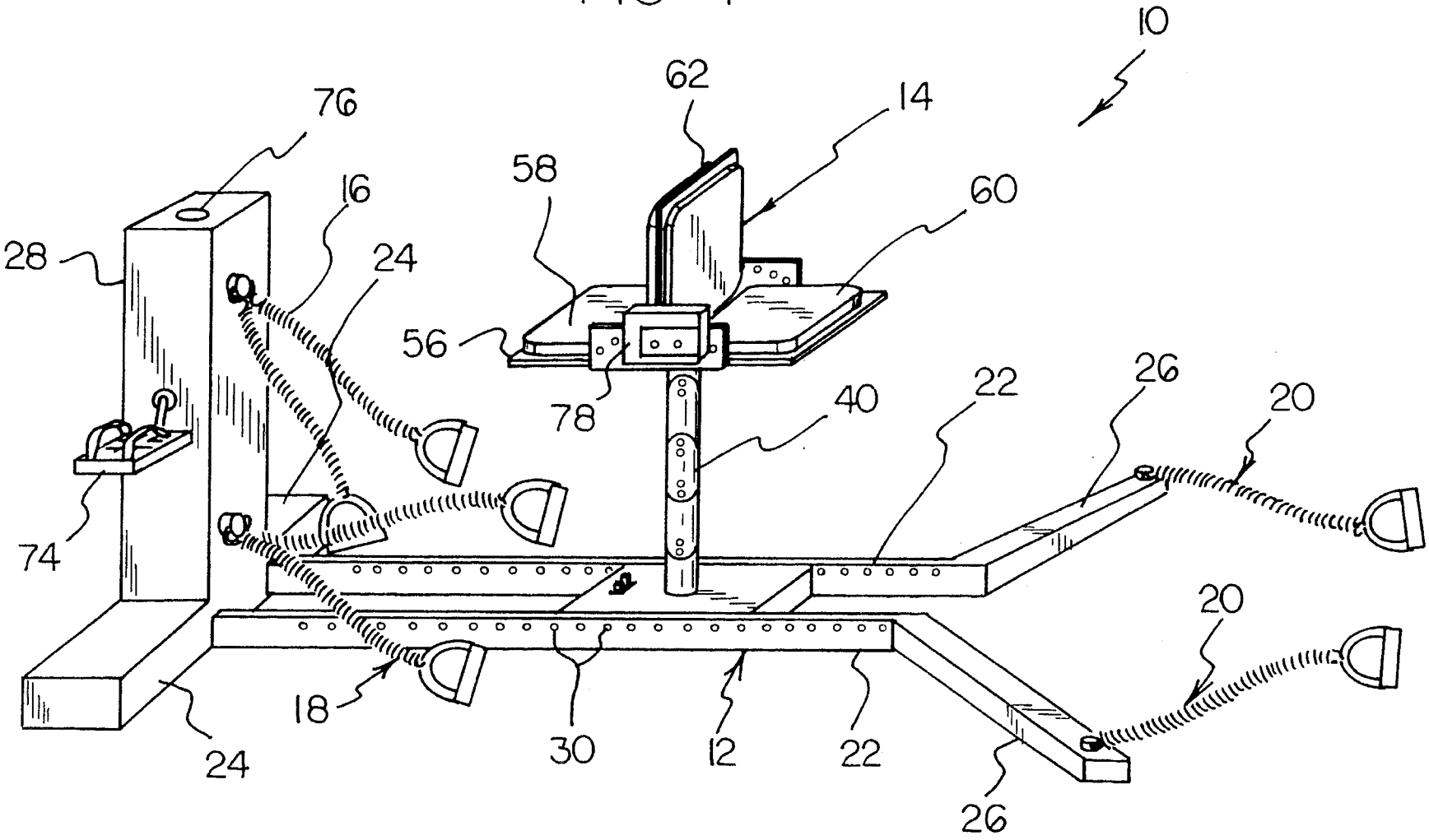
FIG. 1 is an isometric illustration of a resilient tension exercise apparatus according to the present invention.

With reference now to the drawings, and in particular to FIGS. 1–5 thereof, a new resilient tension exercise apparatus embodying the principles and concepts of the present invention and generally designated by the reference numeral 10 will be described.

More specifically, it will be noted that the resilient tension exercise apparatus 10 comprises a frame means 12 for positioning upon a ground surface, and an adjustable seat means 14 adjustably coupled to the frame means 12 for supporting an individual relative to the frame means. A first resilient exercise means 16 is coupled to the frame means 12 and operable for exercising limbs of an individual in a direction of motion having a first angular orientation relative to the frame means. Similarly, a second resilient exercise means 18 is coupled to the frame means 12 and operable for exercising limbs of an individual in a direction of motion having a second angular orientation relative to the frame means. A third resilient exercise means 20 is also coupled to the frame means 2 and operable for exercising limbs of an individual in a direction of motion having a third angular orientation relative to the frame means.

As best illustrated in Figure 1, it can be shown that the frame means 12 according to the present invention 10 preferably comprises a pair of spaced and substantially parallel oriented longitudinal rails 22 coupled together at a first end thereof by a first pair of projecting legs 24. A second pair of projecting legs 26 is coupled to second ends of the longitudinal rails 22 of the frame means 12, with each of the second projecting legs extending outwardly from the longitudinal rails to impart lateral stability to the device 10. A vertical support stanchion 28 extends orthogonally upward from the first pair of projecting legs 24 to complete the frame means 12. The adjustable seat means 14 is movably positioned between the longitudinal rails 22 of the frame means 12 and selectively engages a plurality of frame adjustment apertures 30 to secure a position of the adjustable seat means relative to the frame means in a manner which will be subsequently be described in more detail.

As best illustrated in FIGS. 2 through 5, it can be shown that the seat means 14 according to the present invention 10 preferably comprises a base member 32 having a plurality of wheels 34 rotatably mounted thereto and depending therefrom so as to support the base member 32 in a movable relationship relative to the ground surface upon which the frame means 12 is positioned. The base member 32 is dimensioned so as to fit between the longitudinal rails 22 and includes an unlabelled through-extending bore within which a pair of oppositely positioned locking pins 36 are slidably mounted. A spring 38 is positioned between the locking pins 36 and operates to bias the locking pins into individual adjustment apertures 30 of each of the longitudinal rails 22. By this structure, the locking pins 36 can be selectively biased together to permit movement of the base member between the longitudinal rails 22, whereby a releasing of the locking pins 36 will permit the spring 38 to bias the pins into another opposed pair of adjustment apertures 30 to secure the seat means 14 relative to the frame means 12.

Figure 4:
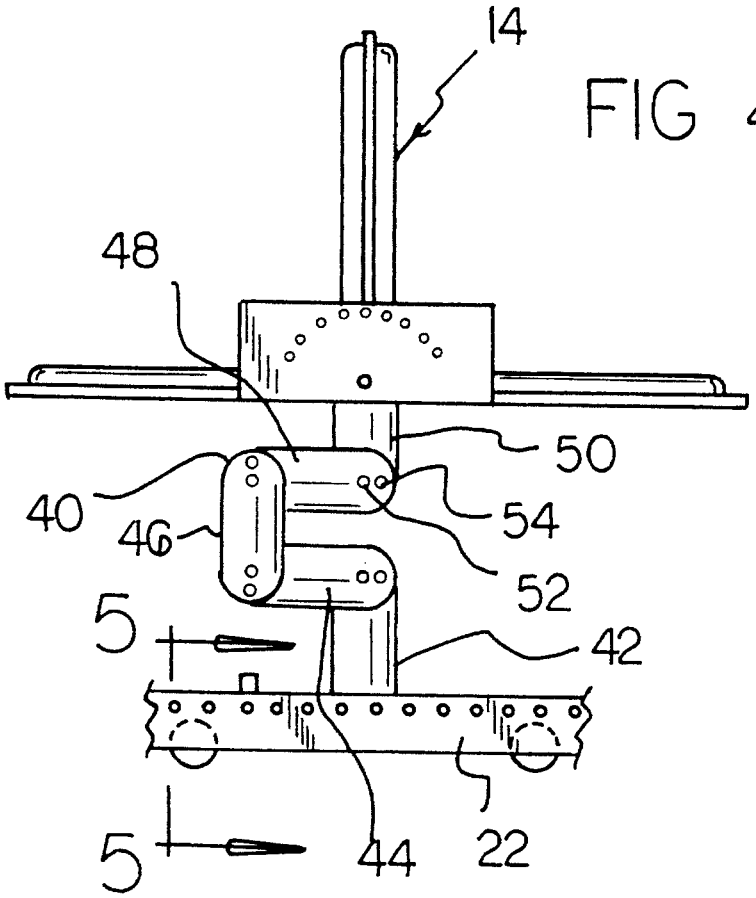
FIG. 4 is a side elevation view of a further portion of the present invention.
Figure 5:
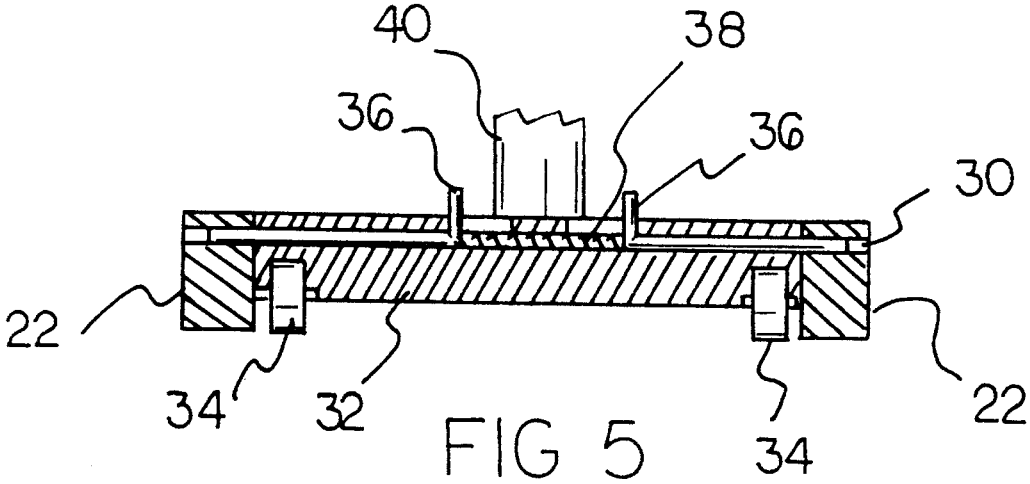
FIG. 5 is a cross sectional view taken along line 5—5 of FIG. 4.

As shown in FIGS. 1 and 4, the seat means 14 further comprises an adjustable stanchion 40 fixedly secured and projecting upwardly from the base member 32. The adjustable stanchion 40 comprises a lower vertical member 42 mounted to the base member 32 and terminating in an upper distal end. A lower medial member 44 is pivotally mounted to the upper distal end of the lower vertical member 42 and extends therefrom to pivotally couple with a center member 46. An upper medial member 48 is pivotally coupled to the center member 46 and extends therefrom to pivotally couple with an upper member 50. The members 44–50 are pivotally mounted to one another by pivot pins 52, as labelled for the pivotal connection between the upper medial member 48 and the upper vertical member 50. Further, each of the members 42–50 includes a plurality of spring-loaded lock buttons 54 which extend into unlabelled eccentric apertures formed proximal to the pivot pins 52. By this structure, a depression of one of the lock buttons 54 will permit a rotation of one of the members 42–50 relative to an adjacent member to provide for articulation and/or vertical adjustment of the adjustable stanchion 40.

Figure 2:
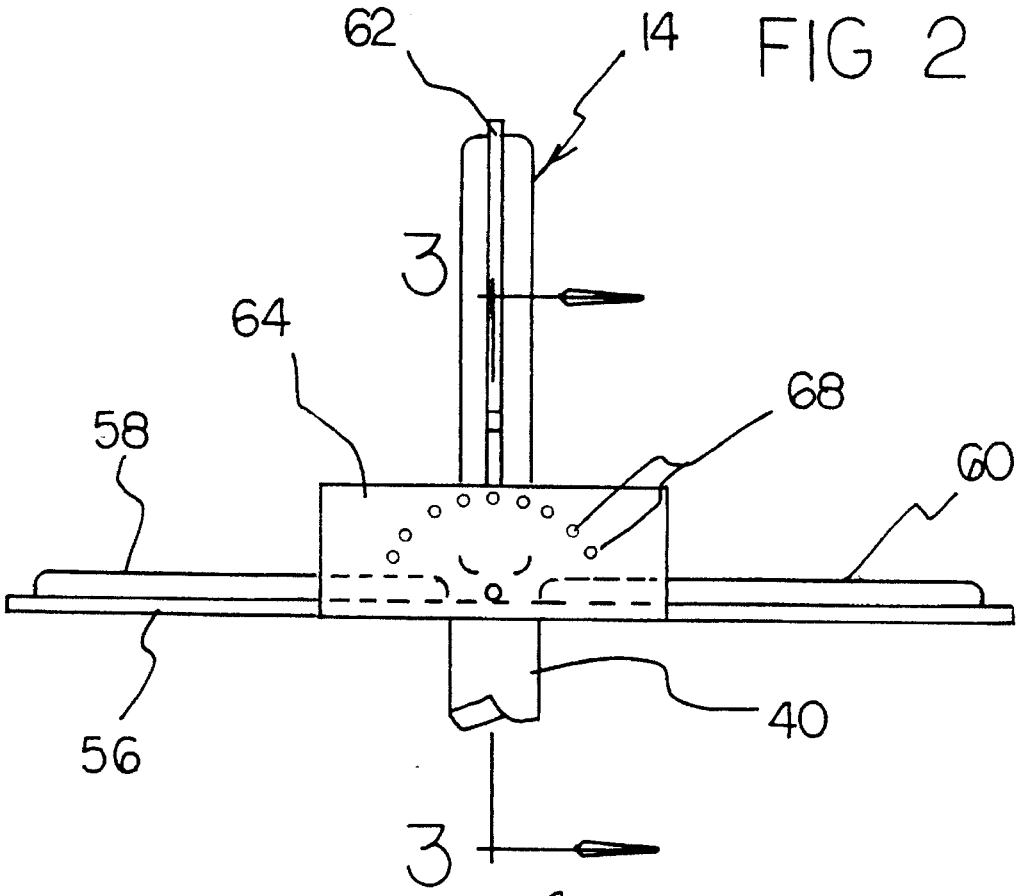
FIG. 2 is a side elevation view of a portion of the present invention.
Figure 3:
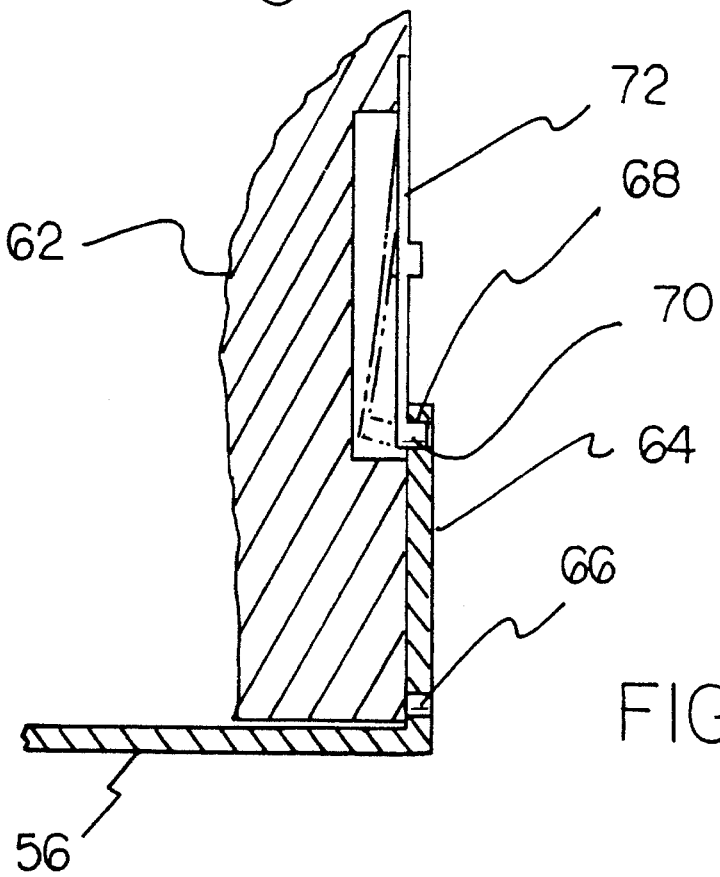
FIG. 3 is a cross sectional view taken along line 3—3 of FIG. 2.

As shown in FIGS. 2 and 3, the seat means 14 further comprises a support plate 56 coupled to the upper vertical member 50 of the adjustable stanchion 40. The support plate 56 extends both forwardly and rearwardly of the adjustable stanchion 40 to define a first seat member 58 positioned in an opposed relationship relative to a second seat member 60. A back rest member 62 is pivotally mounted to the support plate 56 and can be adjusted so as to project at a desired angle therefrom. To this end and as shown in FIG. 3, a pair of adjustment plates 64 are secured to opposed sides of the support plate 56. The back rest member 62 includes oppositely projecting axles 66 which are rotatably mounted relative to the adjustment plate 64 to pivotally mount the back rest member 62 relative to the support plate 56. The adjustment plates 64 each include a plurality of seat adjustment apertures 68 extending in an arcuate pattern and operable to receive a projection 70 of a leaf spring 72. The leaf spring 72 is mounted to the back rest member 62 and can be selectively depressed by an individual to remove the projection 70 from one of the seat adjustment apertures 68 for insertion of the projection into another one of the seat adjustment apertures to lock the back rest member 62 relative to the support plate 56 as desired.

Each of the resilient exercise means 16, as shown in FIG. 1, preferably comprises a pair of elongated springs, or alternatively, elastomeric elements such as rubber bands or rubber tubes, which are coupled to the frame means 12 and extend therefrom to terminate in a pair of unlabelled grips engageable by either the hands or the feet of an individual utilizing the device 10. Preferably, the elongated springs of the first resilient exercise means 16 are mounted together at a common point to an upper portion of the vertical support stanchion 28. The elongated springs of the second resilient exercise means 18 are also preferably mounted together at a common point to a lower portion of the vertical support stanchion 28. In contrast, the elongated springs of the third resilient exercise means 20 are each preferably mounted to an outer distal end of an individual one of the second pair of projecting legs 26 as shown in Figure 1. By such positioning of the resilient exercise means 16–20, an individual residing within the adjustable seat means 14 can exercise the limbs in a direction of various angular orientations relative to the frame means 12.

As shown in Figure 1, the resilient tension exercise apparatus 10 may include a pair of foot rests 74 mounted to respectively opposed sides of the vertical support stanchion 28 for receiving and supporting the feet of an individual. A cup holder 76 can be integrated into an upper surface of the vertical support stanchion 28 and preferably comprises a cylindrical bore directed thereinto. Lastly, a cassette player 78 of conventional design can be secured to the seat means 14 to provide entertainment to an individual during use of the device 10.

In use, the resilient tension exercise apparatus 10 according to the present invention can be utilized to exercise the limbs of an individual either singularly or simultaneously. The adjustable positioning of the seat means 14 relative to the frame means 12, as well as the variety of angular orientations provided by the mounting of the resilient exercise means 16–20 permits an individual using the device 10 to exercise a number of muscle groups in a variety of motions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A resilient tension exercise apparatus comprising:

a frame means for positioning upon a ground surface;

an adjustable seat means adjustably coupled to the frame means for supporting an individual relative to the frame means;

a first resilient exercise means coupled to the frame means and operable for exercising limbs of an individual in a direction of motion having a first angular orientation relative to the frame means;

a second resilient exercise means coupled to the frame means for exercising limbs of an individual in a direction of motion having a second angular orientation relative to the frame means;

a third resilient exercise means coupled to the frame means and operable for exercising limbs of an individual in a direction of motion having a third angular orientation relative to the frame means;

wherein the frame means comprises a pair of spaced and substantially parallel oriented longitudinal rails coupled together at a first end thereof; a first pair of projecting legs extending from the first end of the longitudinal rails; a second pair of projecting legs coupled to second ends of the longitudinal rails, each of the second projecting legs extending outwardly from the longitudinal rails; and a vertical support stanchion extending upward from the first pair of projecting legs, wherein the adjustable seat means is movably positioned between the longitudinal rails of the frame means;

wherein the seat means comprises a base member having a plurality of wheels rotatably mounted thereto and depending therefrom so as to support the base member in a movable relationship relative to a ground surface; an adjustable stanchion secured and projecting upwardly from the base member; a support plate coupled to an upper end of the adjustable stanchion; the support plate extending in opposed directions from the adjustable stanchion to define a first seat member positioned in an opposed relationship relative to a second seat member; and a back rest member pivotally mounted to the support plate.

2. The resilient tension exercise apparatus of claim 1, wherein the adjustable stanchion comprises a lower vertical member mounted to the base member and terminating in an upper distal end; a lower medial member pivotally mounted to the upper distal end of the lower vertical member and extending therefrom; a center member pivotally coupled to the lower medial member; an upper medial member pivotally coupled to the center member and extending therefrom; and an upper member pivotally coupled to the upper medial member, wherein the members are pivotally mounted to one another by pivot pins, with each of the members including a plurality of spring-loaded lock buttons extending into eccentric apertures formed proximal to the pivot pins to selectively lock the members relative to one another.

3. The resilient tension exercise apparatus of claim 2, wherein the base member includes a bore within; a pair of oppositely positioned locking pins slidably mounted within the bore; and a spring positioned between the locking pins, and further wherein the longitudinal rails each include a plurality of adjustment apertures with the pins projecting into the apertures.

4. The resilient tension exercise apparatus of claim 3, wherein a pair of adjustment plates are secured to opposed sides of the support plate, the back rest member including oppositely projecting axles which are rotatably mounted relative to the adjustment plate to pivotally mount the back rest member relative to the support plate, the adjustment plates each including a plurality of seat adjustment apertures extending in an arcuate pattern; a leaf spring mounted to the back rest member and having a projection received within an individual one of the seat adjustment apertures.

5. The resilient tension exercise apparatus of claim 4, wherein each of the resilient exercise means comprises a pair of elongated springs coupled to the frame means and extending therefrom to terminate in a pair of grips.

6. The resilient tension exercise apparatus of claim 5, wherein the elongated springs of the first resilient exercise means are mounted together at a common point to an upper portion of the vertical support stanchion.

7. The resilient tension exercise apparatus of claim 6, wherein the elongated springs of the second resilient exercise means are mounted together at a common point to a lower portion of the vertical support stanchion.

8. The resilient tension exercise apparatus of claim 7, wherein the elongated springs of the third resilient exercise means are each mounted to an outer distal end of an individual one of the second pair of projecting legs.

9. A resilient tension exercise apparatus comprising:

a frame means for positioning upon a ground surface;

an adjustable seat means adjustably coupled to the frame means for supporting an individual relative to the frame means;

a first resilient exercise means coupled to the frame means and operable for exercising limbs of an individual in a direction of motion having a first angular orientation relative to the frame means;

wherein the frame means comprises a pair of spaced and substantially parallel oriented longitudinal rails coupled together at a first end thereof; a first pair of projecting legs extending from the first end of the longitudinal rails; a second pair of projecting legs coupled to second ends of the longitudinal rails, each of the second projecting legs extending outwardly from the longitudinal rails; and a vertical support stanchion extending upward from the first pair of projecting legs, wherein the adjustable seat means is movably positioned between the longitudinal rails of the frame means;

wherein the seat means comprises a base member having a plurality of wheels rotatably mounted thereto and depending therefrom so as to support the base member in a movable relationship relative to a ground surface; an adjustable stanchion secured and projecting upwardly from the base member; a support plate coupled to an upper end of the adjustable stanchion; the support plate extending in opposed directions from the adjustable stanchion to define a first seat member positioned in an opposed relationship relative to a second seat member; and a back rest member pivotally mounted to the support plate.

10. The resilient tension exercise apparatus of claim 9, wherein the adjustable stanchion comprises a lower vertical member mounted to the base member and terminating in an upper distal end; a lower medial member pivotally mounted to the upper distal end of the lower vertical member and extending therefrom; a center member pivotally coupled to the lower medial member; an upper medial member pivotally coupled to the center member and extending therefrom; and an upper member pivotally coupled to the upper medial member, wherein the members are pivotally mounted to one another by pivot pins, with each of the members including a plurality of spring-loaded lock buttons extending into eccentric apertures formed proximal to the pivot pins to selectively lock the members relative to one another.

11. The resilient tension exercise apparatus of claim 10, wherein the base member includes a bore within; a pair of oppositely positioned locking pins slidably mounted within the bore; and a spring positioned between the locking pins, and further wherein the longitudinal rails each include a plurality of adjustment apertures with the pins projecting into the apertures.

12. The resilient tension exercise apparatus of claim 11, wherein a pair of adjustment plates are secured to opposed sides of the support plate, the back rest member including oppositely projecting axles which are rotatably mounted relative to the adjustment plate to pivotally mount the back rest member relative to the support plate, the adjustment plates each including a plurality of seat adjustment apertures extending in an arcuate pattern; a leaf spring mounted to the back rest member and having a projection received within an individual one of the seat adjustment apertures.

13. The resilient tension exercise apparatus of claim 12, wherein each of the resilient exercise means comprises a pair of elongated springs coupled to the frame means and extending therefrom to terminate in a pair of grips.

14. The resilient tension exercise apparatus of claim 13, and further comprising a second resilient exercise means coupled to the frame means for exercising limbs of an individual in a direction of motion having a second angular orientation relative to the frame means.

15. The resilient tension exercise apparatus of claim 14, and further comprising a third resilient exercise means coupled to the frame means and operable for exercising limbs of an individual in a direction of motion having a third angular orientation relative to the frame means.

16. A resilient tension exercise apparatus comprising:

a frame means for positioning upon a ground surface;

an adjustable seat means adjustably coupled to the frame means for supporting an individual relative to the frame means, the seat means comprising a base member having a plurality of wheels rotatably mounted thereto and depending therefrom so as to support the base member in a movable relationship relative to a ground surface; an adjustable stanchion secured and projecting upwardly from the base member; a support plate coupled to an upper end of the adjustable stanchion; the support plate extending in opposed directions from the adjustable stanchion to define a first seat member positioned in an opposed relationship relative to a second seat member; and a back rest member pivotally mounted to the support plate;

and, a first exercise means coupled to the frame means for exercising limbs of an individual.

* * * * *